US008172376B2

(12) United States Patent
Nathan et al.

(10) Patent No.: US 8,172,376 B2
(45) Date of Patent: May 8, 2012

(54) METHOD OF INK SUPPLY TO INKJET PRINT HEAD ARRAY

(75) Inventors: Roi Nathan, Haifa (IL); Haggai Karlinski, Ramat Chen (IL); Gil Fisher, Shoham (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 1129 days.

(21) Appl. No.: 12/026,138

(22) Filed: Feb. 5, 2008

(65) Prior Publication Data

US 2008/0204533 A1 Aug. 28, 2008

Related U.S. Application Data

(60) Provisional application No. 60/888,362, filed on Feb. 6, 2007.

(30) Foreign Application Priority Data

Aug. 2, 2005 (IL) ..... 170026

(51) Int. Cl.
*B41J 2/175* (2006.01)
*B41J 2/19* (2006.01)

(52) U.S. Cl. ..... 347/85; 347/92

(58) Field of Classification Search ..... 347/63, 347/65, 66, 67, 85, 89, 92
See application file for complete search history.

(56) References Cited

U.S. PATENT DOCUMENTS

| | | | | |
|---|---|---|---|---|
| 4,680,696 | A * | 7/1987 | Ebinuma et al. | 347/85 |
| 5,291,215 | A * | 3/1994 | Nozawa et al. | 347/18 |
| 6,007,193 | A * | 12/1999 | Kashimura et al. | 347/92 |
| 6,331,055 | B1 * | 12/2001 | Miller et al. | 347/92 |
| 6,406,137 | B1 * | 6/2002 | Okazaki et al. | 347/93 |

FOREIGN PATENT DOCUMENTS

JP 406008467 A * 1/1994

* cited by examiner

*Primary Examiner* — Anh T. N. Vo

(57) ABSTRACT

Disclosed is an inkjet print head array with improved ink supply system. The system includes an ink manifold having at least two ink supply channels, a plurality of print head modules disposed along ink supply channels and forming the array, with each of the print head modules having at least two ink inlet ports. The ports are in fluid communication with the ink supply channels. Each of the ink supply channels supplies ink to each of the ports at a different flow rate, although the resulting ink supply flow rate is equal for each print head module.

18 Claims, 8 Drawing Sheets

METHOD OF INK SUPPLY TO INKJET PRINT HEAD ARRAY

CLAIM OF PRIORITY

This application claims priority to provisional application No. 60/888,362, filed Feb. 6, 2007, entitled "Method of Ink Supply to Inkjet Print Head Array". The present application is an improvement over the International Patent Cooperation Treaty Application PCT/JP2004/019809 to the same assignee.

TECHNICAL FIELD

The method of ink supply and the print head array relate to digital printing and particularly to inkjet printing with print head arrays.

BACKGROUND

Inkjet printing is a well known in the art printing method. The basics of this technology are described, for example by Jerome L. Johnson "Principles of Non-impact Printing", Palatino Press, 1992, Pages 302-336. ISBN 0-9618005-2-6. Commercial products such as computer printers, large format graphics printers and others exist.

An ink-jet print head consists of an array or a matrix of ink nozzles, with each nozzle selectively ejecting ink droplets. In order to achieve a higher print throughput and higher print resolution individual print heads or print head modules are assembled in arrays. In the context of the present disclosure an array is a one-dimensional or two-dimensional arrangement (assembly) of a number (a plurality) of print head modules.

The larger the number of print head modules of which the array is composed, the more difficult is it to ensure an even supply of ink to each of the print head modules. International Patent Cooperation Treaty Application PCT/JP2004/019809 to the same assignee teaches an ink jet array where inkjet print head modules forming the array, have one ink receiving port, and receive ink from an ink supply channel located below the port. This leads to a situation where the print head modules located along the ink supply channel and distanced from the ink inlet port receive diminishing amounts of ink. When the number of print heads exceeds 24 the array is made with two ink supply channels, although each print head receives the ink from one channel only.

Another problem associated with such arrays is evacuation of ingested or trapped air bubbles. Ingested air remains in the print head and suction needs to be applied in order to evacuate it. The ink enters the print head through arcaded tubing and air bubbles are trapped at the highest point of the arc changing the cross section available for ink conduction.

BRIEF LIST OF DRAWINGS

The print head modules, the array and the method of ink supply are particularly pointed out and distinctly claimed in the concluding portion of the specification. The module, the array and the method, however, both as to organization and method of operation, may best be understood by reference to the following detailed description when read with the accompanied drawings, in which like reference characters refer to the same parts throughout the different views. The drawings are not necessarily to scale, emphasis instead being placed upon illustrating the principles of the method.

DETAILED DESCRIPTION OF THE EXEMPLARY EMBODIMENTS

Figure 1:
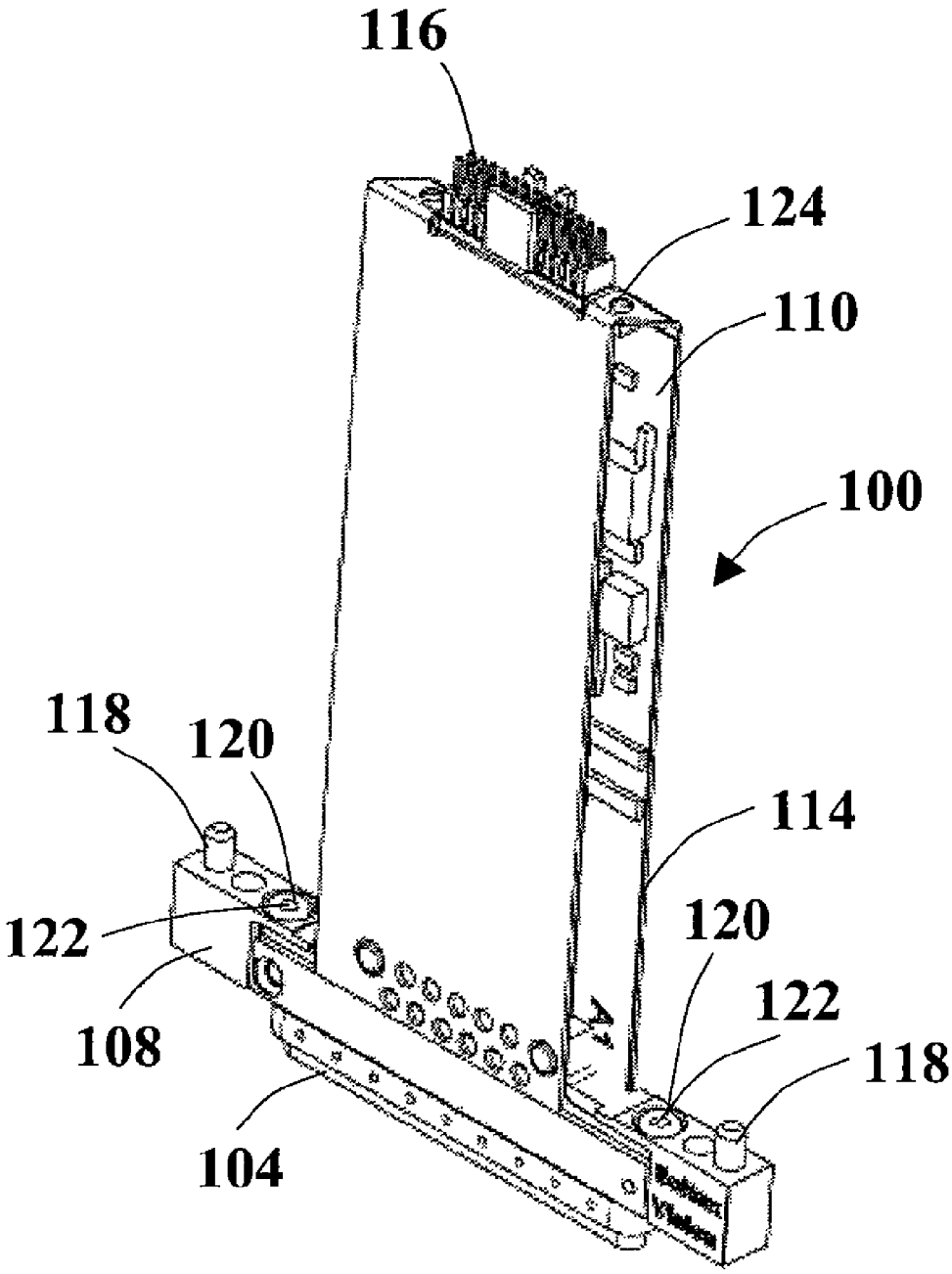
FIG. 1 is a three dimensional schematic illustration of an exemplary inkjet print head module.

FIG. 1 is a three dimensional schematic illustration of an inkjet print head module. Module 100 includes a silicon micro machined part 104, a holder 108 that provides a mechanical interface between silicon part 104 and a flexible printed circuit board 110 with print head driver electronics. Holder 108 may be made from plastic, composite material, metal or any other suitable material. Board 110 is attached to a U-shaped aluminum substrate 114 that provides rigidity to board 110 and serves as a heat sink. Connector 116 protrudes out of U-shaped aluminum substrate 114. Connector 116 facilitates print head board driver 110 connections to a control computer or controller (not shown) that governs the print head operation or the printing process. A pair of registration pins 118 is inserted in holder 108. O-rings 120 overlay ink inlet and ink outlet/return ports 122 formed inside holder 108 (FIG. 2). Each of ports 122 formed inside holder 108 may serve as ink inlet or ink outlet or return port. A Light Emitting Diode (LED) 124 mounted on the top of U-shaped aluminum substrate 114 serves as print head 100 operation or faulty status indicator.

FIG. 2 is a cross section of the exemplary inkjet print head module of FIG. 1. The cross section illustrates silicon micro machined part 104 of print head 100 and holder 108 that provides a mechanical interface between part 104, holder 108 and U-shaped aluminum substrate 114 (FIG. 1). The inner part of holder 108 has an ink tank 130 that supplies and distributes ink to ink compression chambers/channels 134 and nozzles 136. Wall 140 of tank 130 protrudes inside the tank and has a triangular shape oriented with one of its angles toward the opposite side of tank 130. Wall 140 of tank 130 may have other than triangular shapes, e.g., it may be curved with the curvature extending toward the opposite side of tank 130.

Figure 2A:
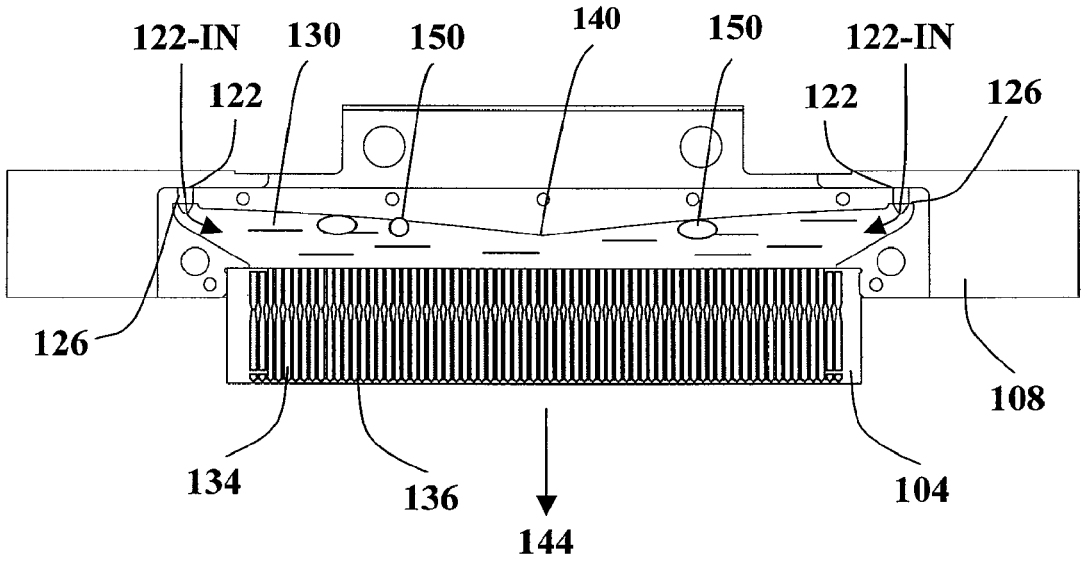
FIGS. 2A and 2B are cross sections of the exemplary inkjet print head module of FIG. 1.
Figure 2B:
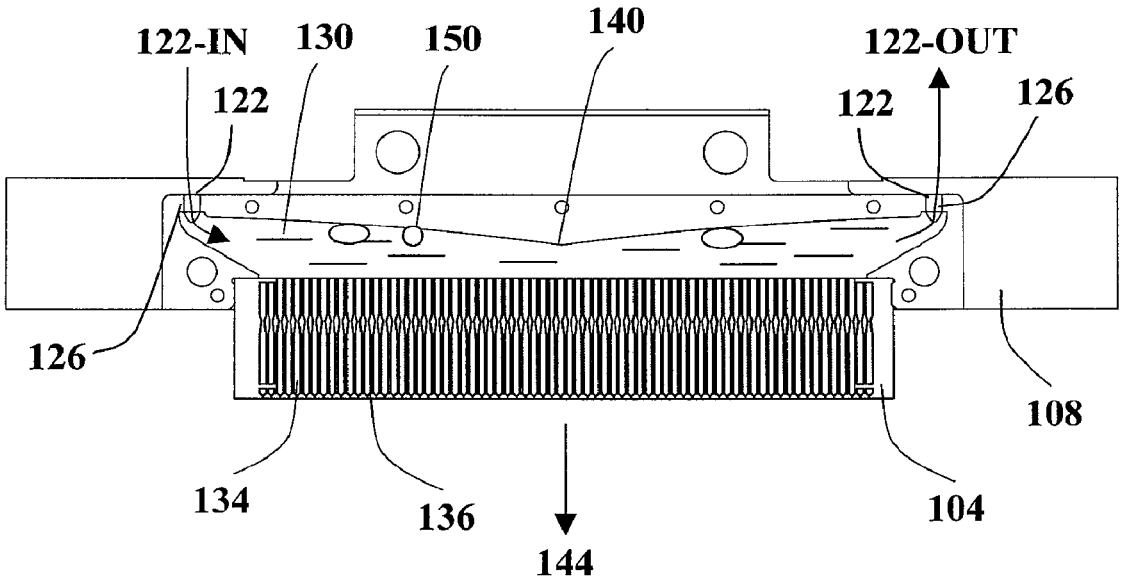

FIG. 2A illustrates a mode of operation of print head module 100 where ink is supplied from both ports 122 and ink conducting channels 126 to tank 130, as shown by arrows 122-IN and ejected through nozzles 136, as schematically illustrated by arrow 144. FIG. 2B illustrates a mode of operation of print head module 100 where one of the ink inlet ports 122 serves as ink outlet port, generating a circulating ink flow through tank 130, as shown by arrows 122-IN and 122-OUT. Nozzles 136 eject a part of ink, as schematically illustrated by arrow 144, and the excessive part/volume of ink is returned from tank 130 through return port 122 in the direction of arrow 122-OUT.

Trapped or ingested air bubbles 150, if such are present in tank 130, are typically gathered/collected around shaped wall 140. Circulating ink flow flows around shaped wall 140, picks-up bubbles 150 and removes them from tank 130.

Figure 3:
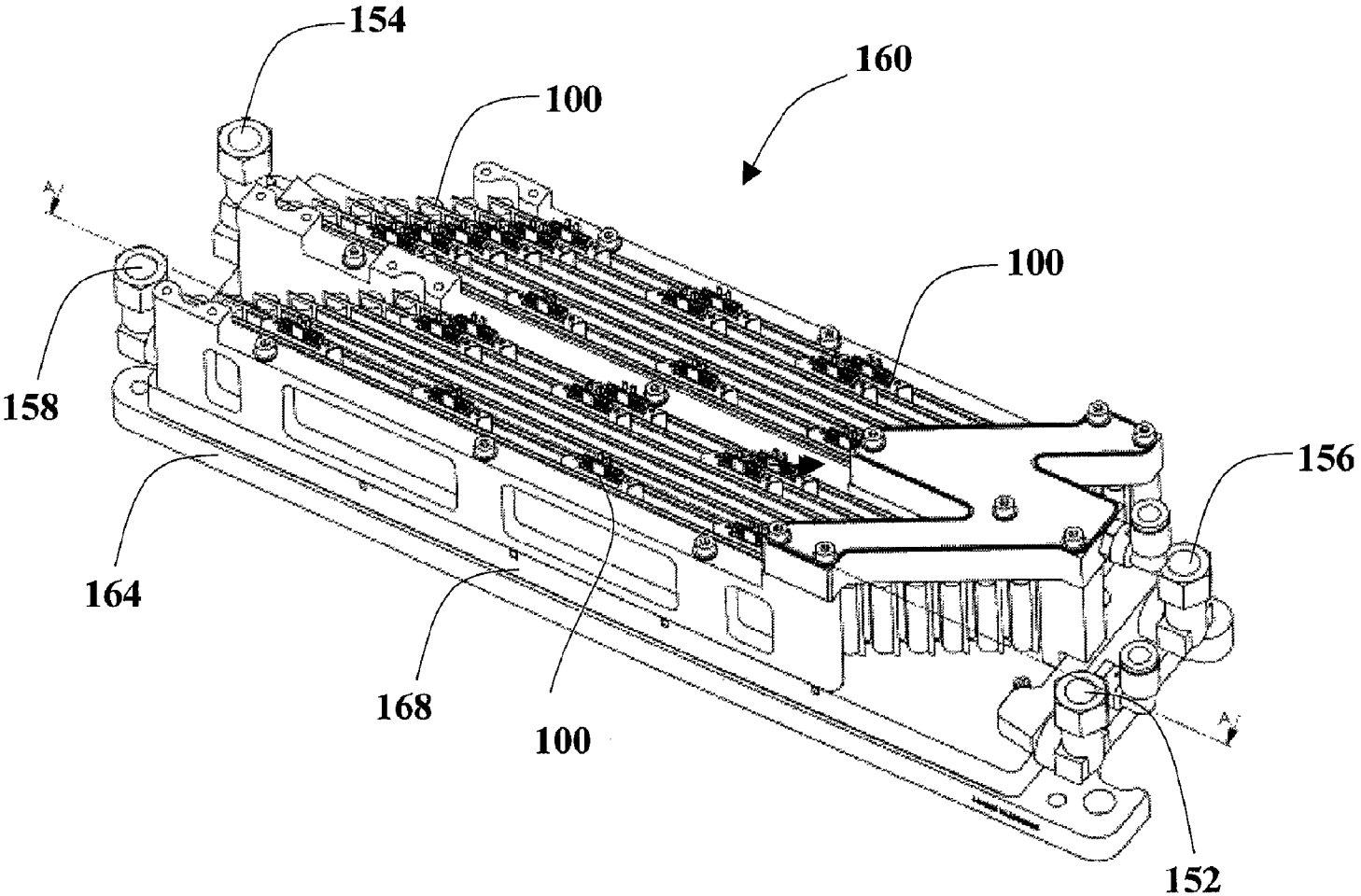
FIG. 3 is a three dimensional schematic illustration of an exemplary embodiment of the inkjet print head array.
Figure 4:
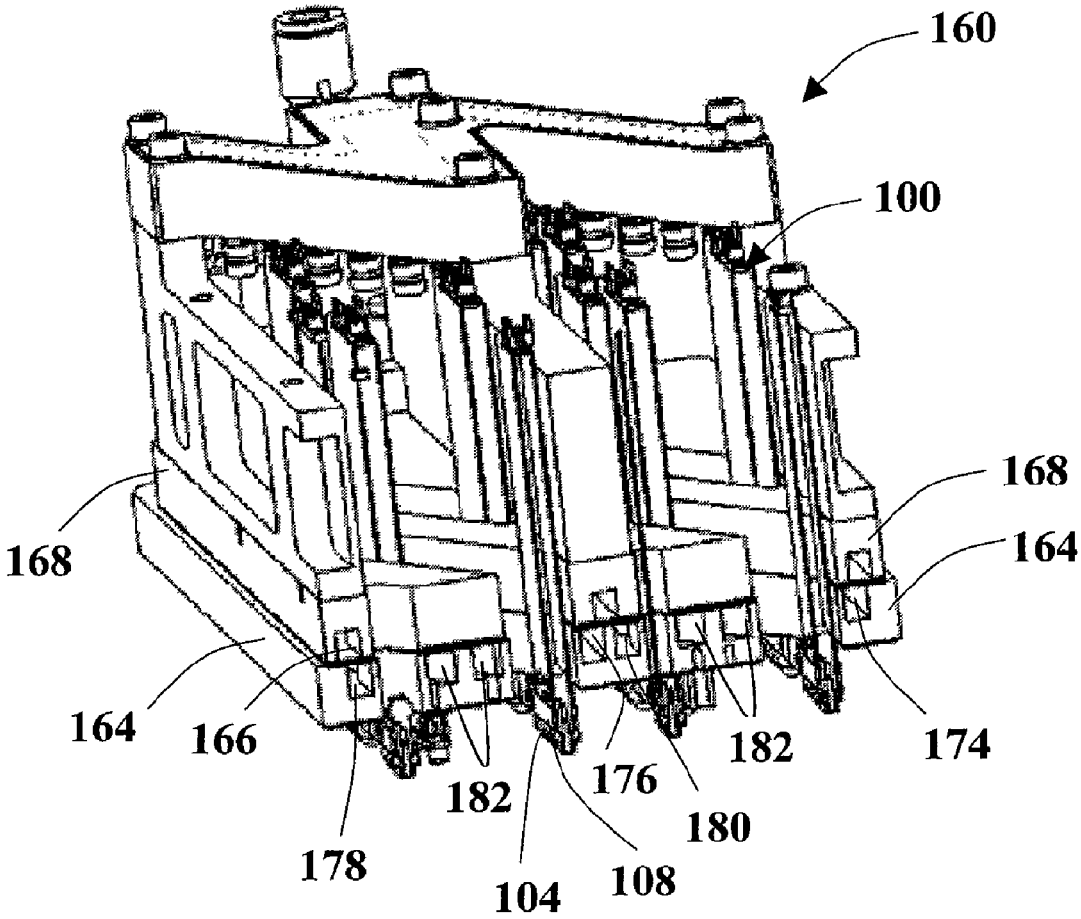
FIG. 4 is a schematic illustration of a cross section of the inkjet print head array of FIG. 3.
Figure 5:
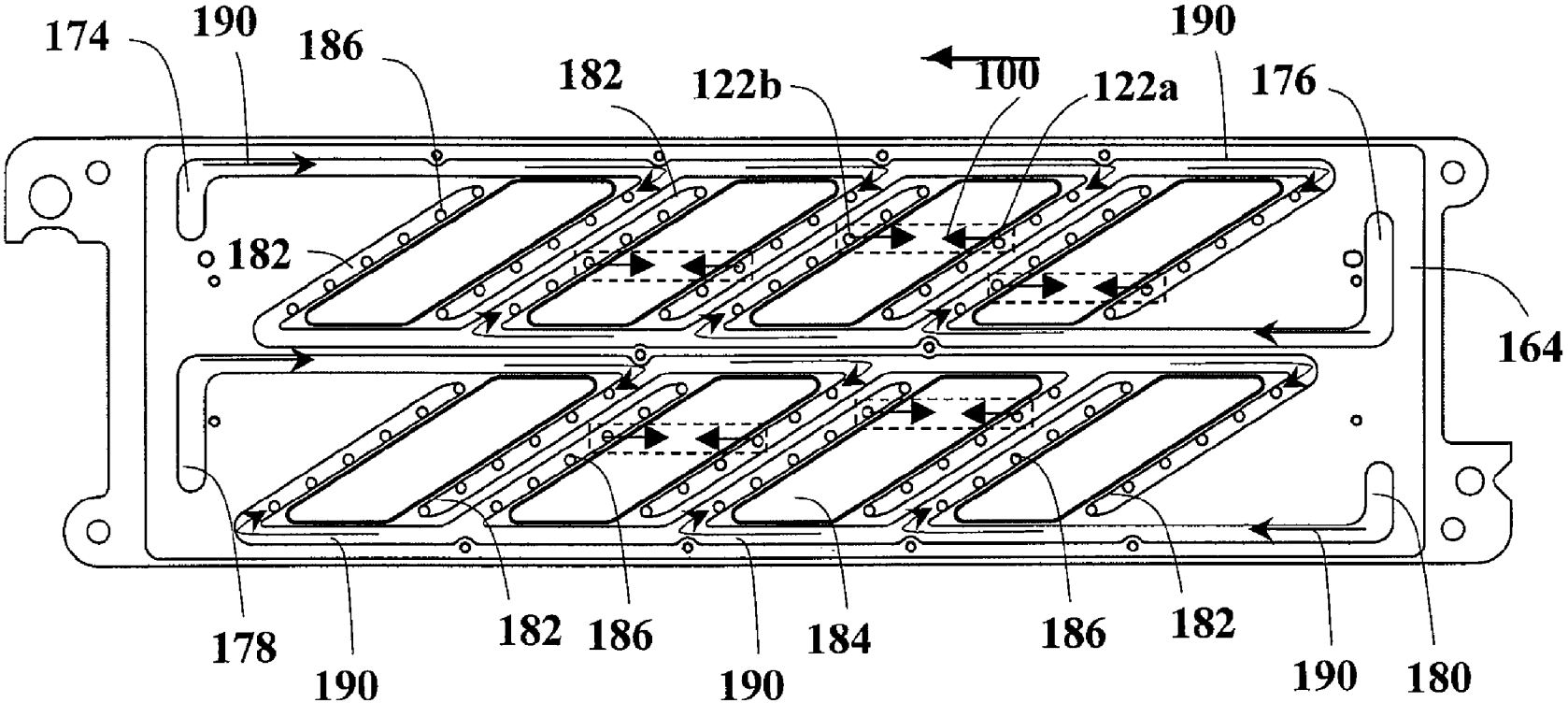
FIG. 5 is a schematic illustration of the print head array ink supply channels and ink flow.
Figure 6:
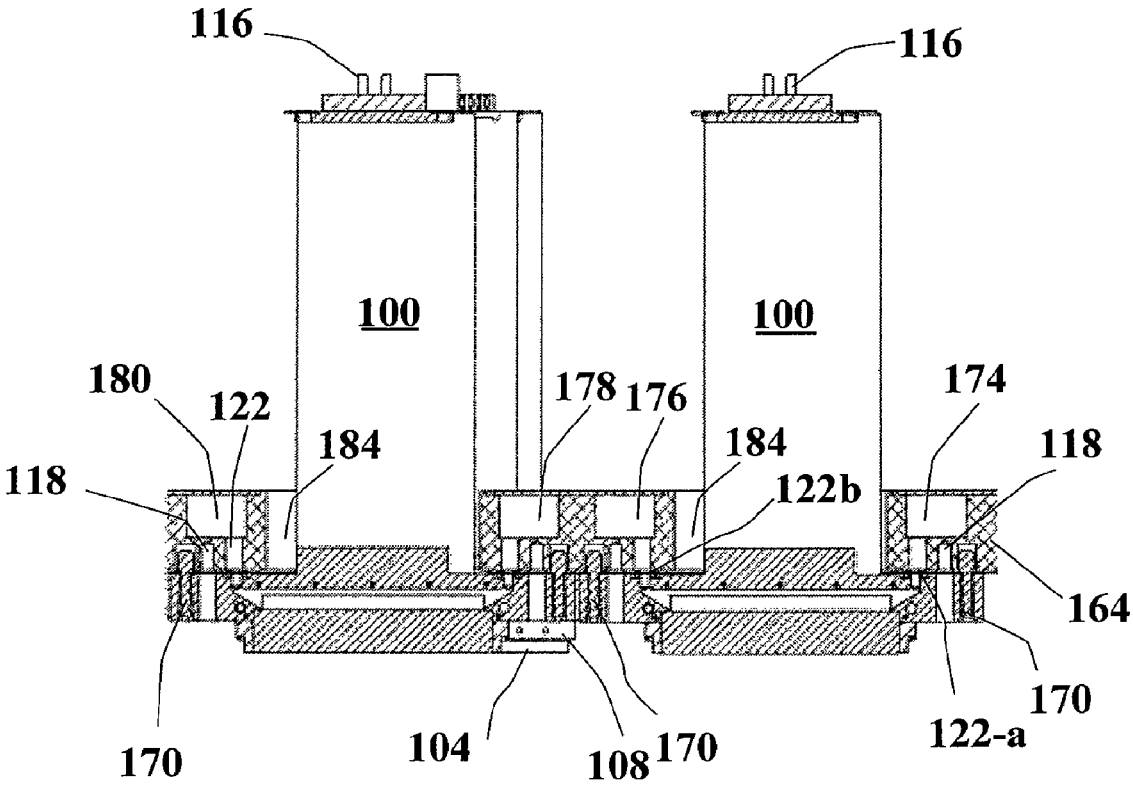
FIG. 6 is a schematic illustration of a cross section of the print head array showing in detail print head module to ink supply/return channels connection.
Figure 7:
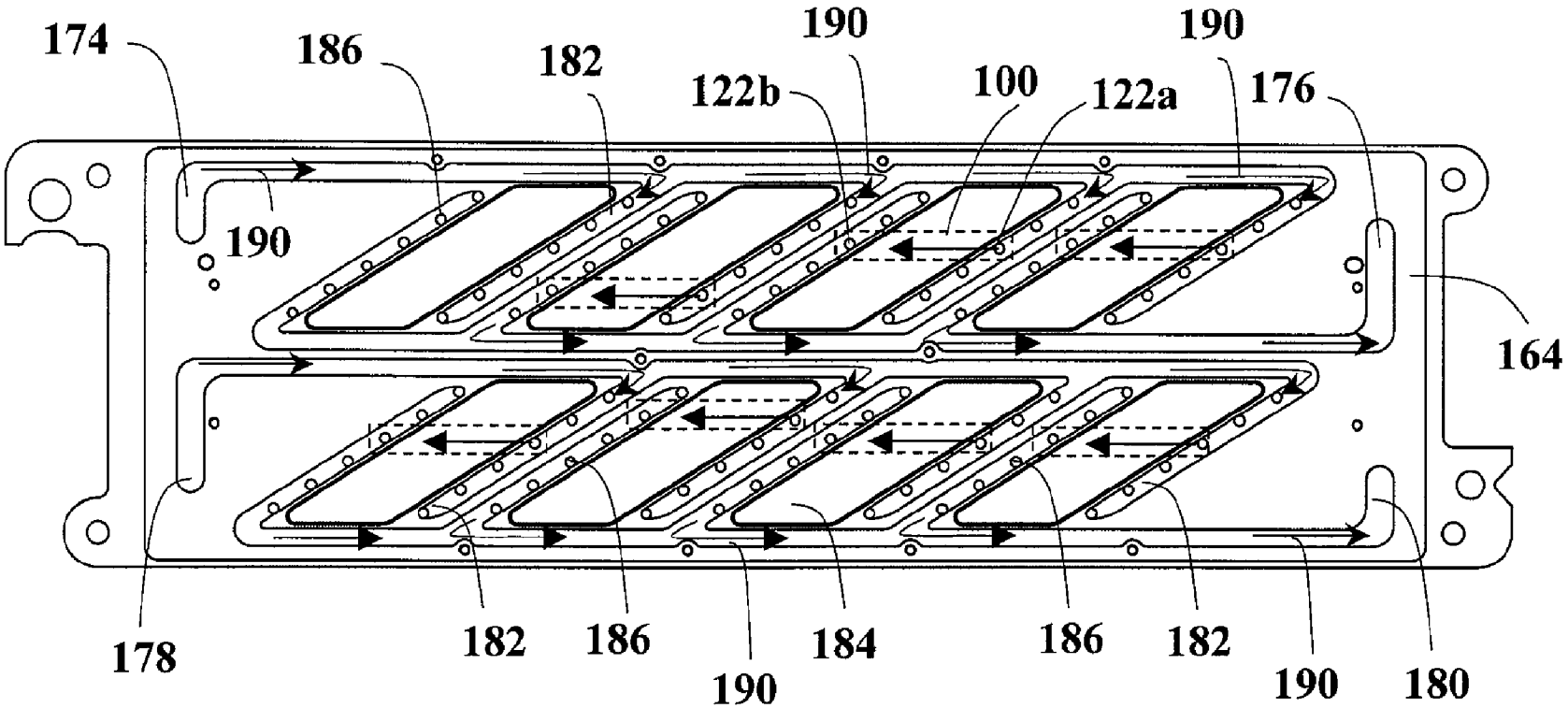
FIG. 7 is a schematic illustration of the print head array ink supply channels and circulating ink flow.

FIG. 3 is a three dimensional schematic illustration of an exemplary embodiment of the inkjet print head array. Array 160 includes a base plate 164 and a top plate 168. Ink receiving ports 152-158 provide ink to one or more ink supply channels 174-180 (FIGS. 4-7). Channels 174-180 made in base plate 164 supply printing ink to print head modules 100. Top plate 168 includes one or more ink heating fluid delivery channels 166 (FIG. 4). Base plate 164 further includes openings 184 that are cut through plate 164 for print head modules 100 insertion. Pins 118 locate print head modules 100 in plate 164 such that their location matches the openings 184 on base plate 164 and fastening screws 170 (FIG. 6) secure modules 100 in the designated location. Modules 100 are located such that ink inlet/return ports overlaid by O-ring 120 are opposite openings 186 of ink supply channels 174-180 (FIGS. 5 and 7). Tightened fastening screws secure modules 100 and apply certain pressure to O-rings 120 that hermetically seal the ink supply path.

A plurality of modules 100 form array 160. Array 160 shown in FIG. 3 has 48 print head modules, but it may have any other number of print head modules. Modules 100 are arranged in two rows with each row consisting of 24 modules 100 placed close to each other to allow formation of a dense, high-resolution array. An alternative arrangement of print head modules 100 in columns is possible. FIG. 4 is a schematic illustration of a cross section of the inkjet print head array 160 showing the position of ink distribution manifold. The manifold includes ink supply and/or return channels 174-180 and their respective branches 182 (FIGS. 5 and 7). Ink in channels 174-180 is well above the level of tank 130. Each group of 24 print heads has its own ink supply channels. Channels 174 and 176 supply ink to one group of modules 100 and channels 178 and 180 to the second group of modules 100. Additionally, each group of print heads may be supplied with ink of different color.

FIG. 5 is a schematic illustration of the print head array ink supply channels. Channels 174-180 are made in base plate 164. Channels 174 and 180 receive ink from one side of plate 164 and channels 176 and 180 receive ink from the other side of plate 164. Each channel 174-180 branches into a series of sub-channels 182 arranged such that when print head modules 100 are inserted into base plate 164 ink inlet/return ports 122 overlaid with O-rings 120 are opposite ink delivery openings 186 made in each sub-channel 182. Under this ink supply scheme each print head module receives ink from both ink inlet ports 122. For example, one of ports 122-*a* of print head module 100 receives ink from ink supply channel 174 and the other port 122-*b* receives from channel 176 (FIG. 6). Arrows 190 (FIGS. 5 and 7) show the ink flow in the system.

Print head modules 100 disposed along ink supply channels 174 and 176 and respective sub-channels 182 receive ink flow from channels 174 and 176. Modules 100 more distanced from the ink receiving port 154 of channel 176 receive diminishing amounts of ink flow. This reduction in the flow rate of ink is compensated by the supply of the ink to the same print head module from ink supply channel 174 where print head module 100 is essentially closer to the ink receiving port 152 of channel 174. Each of modules 100 is in a similar situation i.e., modules distanced from one of the ink channel receiving ports are closer to the other ink channel receiving port. The total length of the ink path for each of modules 100 is equal; accordingly, the pressure drop and the flow rate of ink to each module 100 are equal. Despite the fact that each ink supply channel supplies ink at a different flow rate the resulting ink supply flow rate is equal for each print head module.

FIG. 6 is a schematic illustration of a cross section of the print head array showing in detail print head module 100 to ink supply/return channels connection. Pins 118 locate print head modules 100, which are inserted in openings 168 of base plate 164. Modules 100 are located such that ink inlet/outlet ports 122 overlaid by O-ring 120 are opposite ink delivery/return openings 186 of ink supply channels 174-180 (FIGS. 5 and 7). Tightening fastening screws 170 secures modules 100 and applies certain pressure to O-rings 120 that hermetically seal the ink delivery path. Ink supply/return channels 174-180 are positioned above the ink level in print head 100 ink tank 130. The size of the cross section of ink channels, made in base plate 164, is not restricted (FIG. 6) and according to the number of print head modules forming the array the thickness of plate 164 and cross section of channels 174-178 may be increased.

When an air bubble 150 is trapped or ingested in module 100 or anywhere along the ink path the ink flow direction in one of channels 174 or 176 may be changed as illustrated in FIG. 7. The change of direction in one of the channels creates circulating ink flow in the ink system and through tank 130. As explained supra circulating ink flow picks-up bubbles 150 and removes them from the ink system. Regular ink degassing methods may be applied to the ink that is in the main ink supply tank (not shown) or returns to the tank in case of ink circulation.

A number of embodiments have been described. Nevertheless, it will be understood that various modifications may be made without departing from the spirit and scope of the method. Accordingly, other embodiments are within the scope of the following claims.

The invention claimed is:

1. An inkjet print head array with improved ink supply system comprising:

an ink manifold having at least two ink supply channels;

a plurality of print head modules disposed along said ink supply channels and forming said array, with each of the print head modules having at least two ink ports, said ports being in fluid communication with said ink supply channels, and wherein each of said ink supply channels supplies ink to each of said ports at a different flow rate and wherein a resulting combined ink supply flow rate is equal for each print head module.

2. The array of claim 1, wherein said ink in the ink supply channels flows in opposite direction.

3. The array of claim 1, wherein said ink supply channels receive ink from the opposite sides of said array.

4. The manifold of claim 1, wherein at least one of said ink supply channels serves as an ink return channel.

5. The print head of claim 1, wherein at least one of said ink ports serves as an ink return port.

6. The array of claim 1, wherein at least one of said ink supply channels communicates with at least one of said ink ports to supply ink to the print head module while at least one other of said ink supply channels serving as an ink return channel communicates with at least one other of said ink ports serving as an ink return port and wherein said ink supply generates a circulating ink flow through the print head module from the ink supply channel and ink port that supplies ink to ink port serving as the ink return port and ink supply channel serving as the ink return channel.

7. The array of claim 1, further comprising a tank in fluid communication with the ink inlet ports, the tank having a shaped wall that protrudes inside and towards an opposite side of the tank, the protruding shaped wall to gather and collect air bubbles facilitating removal of the air bubbles.

8. The array of claim 7, wherein the protruding shaped wall has one of a triangular shape and a curved shape.

9. An inkjet print head array with improved ink supply and air removal systems, comprising:

an ink manifold having at least one ink supply channel, and at least one ink return channel;

a number of print head modules disposed along said ink channels and forming said array, said print head modules further comprising:

an ink inlet port and an ink outlet port;

an ink tank, and a feature located in said tank, said feature comprising a shaped wall of the tank that protrudes towards an opposite side of the tank, the feature to gather and collect air bubbles facilitating air bubble removal.

10. The array of claim 9, wherein excessive ink supplied to said ink inlet port is returned through said ink return port.

11. The array of claim 9, wherein supply of excessive ink to said ink inlet port generates a circulating ink flow.

12. The array of claim 9, wherein said circulating ink flow flows along said feature and removes trapped air.

13. The array of claim 9, wherein the level of ink in said manifold is above the level of the ink in said ink tank.

14. The array of claim 9, wherein the protruding wall is a triangular or curved wall.

15. The array of claim 9, wherein each of the ink supply channel and the ink return channel supplies ink to each of the ink inlet port and the ink outlet port at a different flow rate, and wherein a resulting combined ink supply flow rate is equal for each print head module.

16. A micro machined inkjet print head comprising:

an array of silicon micro machined ink compression channels and ink ejecting nozzles;

a holder for holding said silicon micro machined array, said holder further comprising:

an ink inlet and ink return port, and an ink tank having a shaped protruding inside wall.

17. The tank of claim 16, wherein said protruding wall is a triangular or curved wall.

18. The micro machined inkjet print head of claim 16, wherein each of the ink inlet port and the ink return port to receive ink at a different flow rate, and wherein a resulting combined ink supply flow rate is equal for the micro machined inkjet print head substantially regardless of a position of the micro machined inkjet print head within an inkjet print head array.

* * * * *